US005547790A

United States Patent [19]

Umeda et al.

[11] Patent Number: 5,547,790

[45] Date of Patent: Aug. 20, 1996

[54] ELECTROPHOTOGRAPHIC PHOTOCONDUCTOR CONTAINING POLYMERIC CHARGE TRANSPORTING MATERIAL IN CHARGE GENERATING AND TRANSPORTING LAYERS

[75] Inventors: Minoru Umeda; Tatsuya Niimi, both of Numazu, Japan

[73] Assignee: Ricoh Company, Ltd., Tokyo, Japan

[21] Appl. No.: 326,700

[22] Filed: Oct. 20, 1994

[30] Foreign Application Priority Data

Oct. 20, 1993 [JP] Japan ..... 5-262409

[51] Int. Cl.[6] ..... G03G 5/047

[52] U.S. Cl. ..... 430/58; 430/59

[58] Field of Search ..... 430/58, 59

[56] References Cited

U.S. PATENT DOCUMENTS 4,743,523 5/1988 Yamashita et al. ..... 430/58

5,028,687 7/1991 Yanus et al. ..... 528/203

5,066,796 11/1991 Law ..... 430/78

5,310,613 5/1994 Pai et al. ..... 430/59

5,316,880 5/1994 Pai et al. ..... 430/59

5,342,719 8/1994 Pai et al. ..... 430/59

*Primary Examiner*—Christopher D. Rodee

*Attorney, Agent, or Firm*—Oblon, Spivak, McClelland, Maier, & Neustadt, P.C.

[57] ABSTRACT

An electrophotographic photoconductor including an electroconductive support and a photoconductive layer formed thereon, which has at least a charge generation layer containing a charge generating material and a polymeric charge transporting material, and a charge transport layer containing a polymeric charge transporting material.

12 Claims, 1 Drawing Sheet

ELECTROPHOTOGRAPHIC PHOTOCONDUCTOR CONTAINING POLYMERIC CHARGE TRANSPORTING MATERIAL IN CHARGE GENERATING AND TRANSPORTING LAYERS

BACKGROUND OF THE INVENTION

1. Field of the Invention

The present invention relates to an electrophotographic photoconductor used in a copying machine, a laser printer and a laser facsimile apparatus, and more particularly to an electrophotographic photoconductor comprising a charge transport layer which comprises a polymeric charge transporting material.

2. Discussion of Background

The Carlson process and other processes obtained by modifying the Carlson process are conventionally known as the electrophotographic methods, and widely utilized in the copying machine and printer. In a photoconductor for use with the electrophotographic method, an organic photoconductive material is now widely used because such a photoconductor can be manufactured at low cost by mass production, and causes no environmental pollution.

Many kinds of organic photoconductors are conventionally proposed, for example, a photoconductor employing a photoconductive resin such as polyvinyl carbazole (PVK); a photoconductor comprising a charge transport complex of polyvinyl carbazole (PVK) and 2,4,7-trinitrofluorenone (TNF); a photoconductor of a pigment dispersed type in which a phthalocyanine pigment is dispersed in a binder resin; and a function-separating photoconductor comprising a charge generating material and a charge transporting material. In particular, the function separating photoconductor has now attracted considerable attention.

When the function separating photoconductor is charged to a predetermined polarity and exposed to light, the light pass through a transparent charge transport layer, and is absorbed by a charge generating material in a charge generation layer. The charge generating material generates charge carriers by the absorption of light. The charge carriers generated in the charge generation layer are injected into the charge transport layer, and move in the charge transport layer depending on the electrical field generated by the charging process. Thus, latent electrostatic images are formed on the surface of the photoconductor by neutralizing the charge thereon. As is known, it is effective that the function separating electrophotographic photoconductor employ in combination a charge transporting material having an absorption intensity mainly in the ultraviolet region, and a charge generating material having an absorption intensity in a range from the visible region extending to the near infrared region.

Many low-molecular weight compounds have been developed to obtain the charge transporting materials. However, it is necessary that the low-molecular weight charge transporting material be dispersed and mixed with an inert polymer to prepare a coating liquid for a charge transport layer because the film-forming properties of such a low-molecular weight compound is very poor. The charge transport layer thus prepared by using the low-molecular weight compound and the inert polymer is generally so soft, that peeling of the charge transport layer easily occurs during the repeated electrophotographic operations by the Carlson process.

In addition, the charge mobility has its limit in the above-mentioned charge transport layer employing the low-molecular weight charge transporting material. The Carlson process cannot be carried out at a high speed, and the size of apparatus cannot be decreased due to the poor charge mobility in the charge transport layer when the amount of the low-molecular weight charge transporting material is 50 wt. % or less to the weight of the charge transport layer. Although the charge mobility can be improved by increasing the amount of the charge transporting material, the film-forming properties deteriorate.

To solve the problems of the low-molecular weight charge transporting material, considerable attention has been paid to a high-molecular weight charge transporting material. For example, a variety of high-molecular weight charge transporting materials are proposed as disclosed in Japanese Laid-Open Patent Applications Nos. 50-82056, 51-73888, 54-8527, 54-11737, 56-150749, 57-78402, 63-285552, 1-1728, 1-19049 and 3-50555.

However, photosensitivity of the function-separating laminated photoconductor in which a charge transport layer comprises a high-molecular weight charge transporting material is extraordinarily inferior to that of the above-mentioned laminated photoconductor employing a low-molecular weight charge transporting material in the charge transport layer.

To improve the photosensitivity of a laminated electrophotographic photoconductor in which a high-molecular weight charge transporting material is employed in the charge transport layer, it is proposed to add a low-molecular weight charge transporting material to the charge generation layer or the charge transport layer, as disclosed in Japanese Laid-Open Patent Application 5-34938. However, when the low-molecular weight charge transporting material is added to the high-molecular weight charge transporting material in the charge transport layer, the peeling of the charge transport layer easily occurs during the repeated operations. On the other hand, when the low-molecular weight charge transporting material is contained in the charge generation layer, the photosensitivity slightly increases, but does not attain to a satisfactory level.

As previously explained, when the charge transport layer of the function separating laminated photoconductor comprises the low-molecular weight charge transporting material and the inert polymer, the charge mobility, that is, the response speed has the limitation, and the charge transport layer easily tends to peel during the repeated operations.

The laminated photoconductor in which the high-molecular weight charge transporting material is employed in the charge transport layer can solve the above-mentioned problems, but causes a fatal problem of low photosensitivity. All the characteristics cannot be satisfied as mentioned above even though the high-molecular weight charge transporting material is used in combination with the low-molecular weight charge transporting material.

SUMMARY OF THE INVENTION

Accordingly, a first object of the present invention is to provide an electrophotographic photoconductor with high photosensitivity.

A second object of the present invention is to provide an electrophotographic photoconductor capable of attaining a quick photoresponse performance.

A third object of the present invention is to provide an electrophotographic photoconductor showing excellent abrasion resistance during the repeated operations.

The above-mentioned objects of the present invention can be achieved by an electrophotographic photoconductor comprising an electroconductive support and a photoconductive layer formed thereon, which comprises at least a charge generation layer comprising a charge generating material and a polymeric charge transporting material, and a charge transport layer comprising a polymeric charge transporting material.

In the first mentioned electrophotographic photoconductor, the polymeric charge transporting material for use in the charge generation layer may be selected from the group consisting of polysilylene, a polymer having a hydrazone structure on the main chain and/or side chain thereof, and a polymer having a tertiary amine structure on the main chain and/or side chain thereof.

In the first mentioned electrophotographic photoconductor, the charge generating material for use in the charge generation layer may be an organic material.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
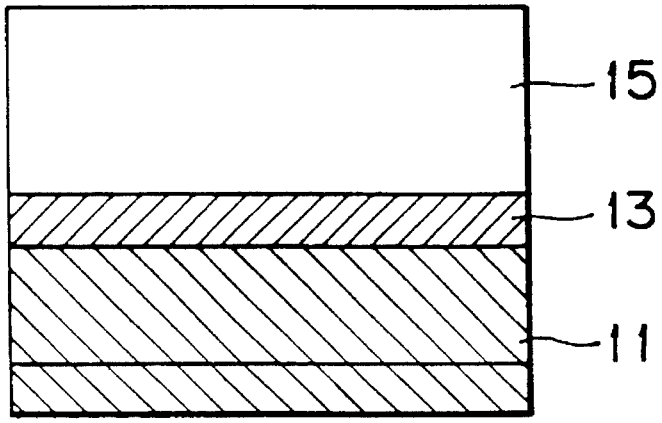
FIG. 1 is a schematic cross-sectional view which shows one embodiment of an electrophotographic photoconductor according to the present invention.

It is considered that photocarriers are generated when the charge generating material is subjected to the light excitation in the charge generation layer.

The inventors of the present invention have conducted a study of the generation of photocarriers in the laminated photoconductor in which a bisazo pigment and a trisazo pigment are contained in a charge generation layer. As a result, it is found that exciton is generated in the charge generation layer after absorption of light, and the exciton causes dissociation at the interface between the charge generation layer and the charge transport layer, thereby generating photocarrier. Such a discovery is reported in the Japanese Journal of Applied Physics Vol. 29, No. 12, pp. 2746–2750, and the Japanese Journal of Applied Physics Vol. 72, No. 1, pp. 117–123.

After further intensive study, the inventors of the present invention have come to the following conclusions (1) All the organic charge generating materials can contribute to the generation of photocarrier at the interface between the charge generation layer and the charge transport layer.

(2) In the case where a low-molecular weight charge transporting material is employed, a large quantity of photocarriers are generated when a charge generating material is well mixed with the low-molecular weight charge transporting material, and brought into contact with the low-molecular weight charge transporting material.

(3) The photocarrier can also be generated by the contact of a charge generating material and a high-molecular weight charge transporting material. A large quantity of photocarriers are generated when the charge generating material is well mixed with the high-molecular weight charge transporting material, and brought into contact with the high-molecular weight charge transporting material.

(4) The low-molecular weight charge transporting material contained in the charge transport layer permeates through the charge generation layer in the case where the charge transport layer is formed by the conventional casting method. Therefore, the low-molecular weight charge transporting material can be sufficiently brought into contact with the charge generating material. In contrast to this, the high-molecular weight charge transporting material cannot permeate through the charge generation layer, so that the contact with the charge generating material becomes insufficient. Consequently, the amount of generated photocarriers is small, which causes the low photosensitivity.

On the basis of the above-mentioned study, the inventors of the present invention have succeeded in the improvement of photosensitivity of a laminated photoconductor comprising the high-molecular weight charge transporting material without using any low-molecular weight charge transporting material.

More specifically, an electrophotographic photoconductor according to the present invention comprises an electroconductive support and a photoconductive layer formed thereon, which comprises at least a charge generation layer comprising a charge generating material and a polymeric charge transporting material, and a charge transport layer comprising a polymeric charge transporting material.

When the polymeric charge transporting material is used in the charge transport layer, the polymeric charge transporting material cannot permeate through the charge generation layer when the charge transport layer is provided by the casting method. This is because the diffusion constant of the polymeric charge transporting material is small due to its large molecular weight. Therefore, the charge generating material comes into contact with the polymeric charge transporting material only at the interface between the charge generation layer and the charge transport layer. As a result, the site where the photocarrier can be generated (hereinafter referred to as the carrier generation site) is restricted.

According to the present invention, the carrier generation sites can adequately be ensured in the charge generation layer because a polymeric charge transporting material is previously added to the charge generation layer. Although the charge transport layer comprising a polymeric charge transporting material is provided, ample carrier generation sites can be retained. Therefore, high photosensitivity can be obtained.

In particular, the photocarriers can be generated between the charge generating material and the polymeric charge transporting material in a better condition in the charge generation layer and the photosensitivity of the photoconductor is further increased when the specific polymeric charge transporting materials to be described later are employed, and the charge generating material for use in the charge generation layer is an organic material.

In addition, since the charge transport layer of the photoconductor according to the present invention comprises a polymeric charge transporting material, the charge mobility can be increased due to a high density of charge transporting sites in the charge transport layer. Accordingly, the photoconductor of the present invention is provided with high-speed photoresponse performance, which has never been achieved in the conventional charge transport layer comprising a low-molecular weight charge transporting material and an inert polymer.

Furthermore, the hardness of the charge transport layer for use in the present invention is improved because only polymeric materials are contained therein. The peeling of the charge transport layer can be prevented even though the photoconductor is repeatedly used for a long period of time.

The structure of the electrophotographic photoconductor according to the present invention will now be explained in detail by referring to FIGS. 1 and 2.

Figure 2:
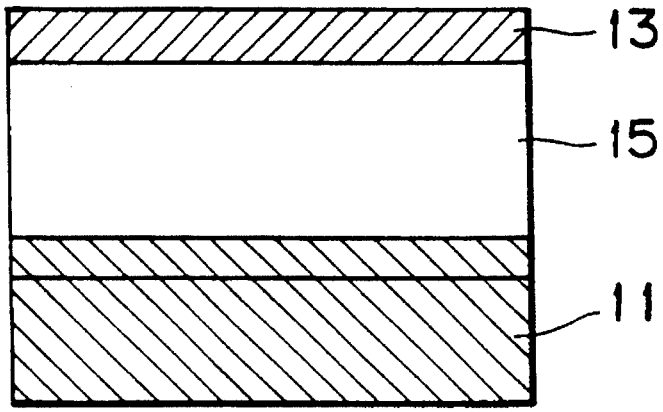
FIG. 2 is a schematic cross-sectional view which shows another embodiment of an electrophotographic photoconductor according to the present invention.

FIGS. 1 and 2 are schematic cross-sectional views which show the embodiments of an electrophotographic photoconductor according to the present invention. As shown in FIGS. 1 and 2, a photoconductive layer comprising a charge generation layer 13 which comprises a charge generating material and a polymeric charge transporting material, and a charge transport layer 15 which comprises a polymeric charge transporting material is overlaid on an electroconductive support 11.

The laminating order of the charge generation layer 13 and the charge transport layer 15 is reversed in a photoconductor shown in FIG. 2 as compared with the photoconductor shown in FIG. 1.

The electroconductive support 11 of the photoconductor according to the present invention may exhibit electroconductive properties, and have a volume resistivity of $10^{10}$ Ω·cm or less. The electroconductive support 11 can be prepared by coating a plastic film or a sheet of paper, which may be in the cylindrical form, with metals such as aluminum, nickel, chromium, nichrome, copper, silver, gold and platinum, or metallic oxides such as tin oxide and indium oxide by the vacuum deposition or sputtering method. Alternatively, a sheet of aluminum, aluminum alloys, nickel, or stainless steel may be formed into a tube by the drawing end ironing (D.I.) method, the impact ironing (I.I.) method, the extrusion method or the pultrusion method. Subsequently, the tube thus obtained may be subjected to surface treatment such as machining or abrasion to prepare the electroconductive support 11 for use in the photoconductor of the present invention.

The charge generation layer 13 comprises as the main components the charge generating material and polymeric charge transporting material.

Specific examples of the charge generating material include organic materials such es monoazo pigment, disazo pigment, trisazo pigment, perylene pigment, perinone pigment, quinacridone pigment, quinone condensation polycyclic compound, squaraines, phthalocyanine pigment, naphthalocyanine pigment, and azulenium salt dye; and inorganic materials such as selenium, selenium-tellurium, selenium-arsenic compound, and a-silicon (amorphous silicon).

Particularly, the above-mentioned organic materials such as azo pigment, perylene pigment, perinone pigment, quinacridone pigment, quinone condensation polycyclic compound, squaraines, phthalocyanine pigment, naphthalocyanine pigment, and azulenium salt dye can produce good results. Of the above organic materials, the azo pigment, perylene pigment, perinone pigment, quinacridone pigment, quinone condensation polycyclic compound, squaraines, and azulenium salt dye are further preferable.

The above-mentioned charge generating material can be used alone or in combination in the charge generation layer 13.

The polymeric charge traneporting material for use in the charge generation layer 13 and the charge transport layer 15 is not particularly limited.

It is preferable that the weight-average molecular weight (Mw) of the polymeric charge transporting material for use in the charge generation layer 13 and the charge transport layer 15 be in the range of 1,000 to 2,000,000, and more preferably in the range of 10,000 to 1,000,000.

In particular, the following polymeric charge transporting materials are preferably employed in the charge generation layer 13 for use in the present invention:

(a) A polymeric material having a carbazole ring on the main chain and/or side chain thereof.

For example, poly-N-vinylcarbazole, and compounds as disclosed in Japanese Laid-Open Patent Applications Nos. 50-82056, 54-9632, 54-11737 and 4-183719 can be employed.

(b) A polymeric material having a hydrazone structure on the main chain and/or side chain thereof.

For example, compounds as disclosed in Japanese Laid-Open Patent Applications Nos. 57-78402 and 3-50555 can be employed.

(c) Polysilylene.

For example, compounds as disclosed in Japanese Laid-Open Patent Applications Nos. 63-285552, 5-19497 and 5-70595 can be employed.

(d) A polymeric material having a tertiary amine structure on the main chain and/or side chain thereof.

For example, N,N-bis(4-methylphenyl)-4-aminopolystyrene, and compounds as disclosed in Japanese Laid-Open Patent Applications Nos. 1-13061, 1-19049, 1-1728, 1-105260, 2-167335, 5-66598 and 5-40350 can be employed.

(e) Other polymeric materials.

For example, formaldehyde condensation polymer of nitropylene, and compounds as disclosed in Japanese Laid-Open Patent Applications Nos. 51-73888 and 56-150749 can be employed.

The polymeric charge transporting material for use in the charge generation layer 13 is not limited to the above-mentioned materials. For instance, a copolymer consisting of conventional monomers, a block polymer, a graft polymer, a star shaped polymer, and a crosslinked polymer having an electron donor group as disclosed in Japanese Laid-Open Patent Application 3-109406 can also be employed.

To obtain good results in the present invention, the above-mentioned polymeric materials (b), (c) and (d) are preferably employed as the polymeric charge transporting materials for use in the charge generation layer 13.

To improve the photosensitivity of the photoconductor, it is preferable that the ionization potential ($I_P$) of the polymeric charge transporting material for use in the charge generation layer 13 and the ionization potential ($I_p'$) of the charge generating material satisfy the relationship of $(I_P)<(I_P')+0.2$ eV.

It is preferable that the polymeric charge transporting material be contained in the charge generation layer 13 in an amount of 0.1 to 10 parts by weight, more preferably 0.2 to 5 parts by weight, to one part by weight of the charge generating material.

The charge generation layer 13 may further comprise an electrically inert binder resin when necessary.

Examples of such a binder resin for use in the charge generation layer 13 are polyamide, polyurethane, polyester, epoxy resin, polyketone, polycarbonate, silicone resin, acrylic resin, polyvinyl butyral, polyvinyl formal, polyvinyl ketone, polystyrene and polyacrylamide.

To prepare the charge generation layer 13, the charge generating material and the polymeric charge transporting material are dispersed in a proper solvent such as tetrahydrofuran, cyclohexanone, dioxane, 2-butanone or dichloroethane in a ball mill, an attritor or a sand mill. The dispersion thus obtained may appropriately be diluted to prepare a coating liquid for the charge generation layer 13. The coating liquid for the charge generation layer 13 is applied to the electroconductive support 11 in FIG. 1, or to the charge transport layer 15 in FIG. 2, by dip coating, spray coating or beads coating.

Alternatively, a dispersion of the charge generating material and a solution of the polymeric charge transporting material are separately prepared and coated by spray coating. The dispersion of the charge generating material and the solution of the polymeric charge transporting material may be mixed together and the thus obtained mixture may be subjected to spray coating.

It is preferable that the thickness of the charge generation layer 13 be in the range of about 0.01 to 5 μm, more preferably in the range of 0.1 to 2 μm.

The charge transport layer 15 comprises the polymeric charge transporting material. When the charge transport layer 15 is provided, the polymeric charge transporting material is dissolved or dispersed in a proper solvent such as tetrahydrofuran, dioxane, toluene, monochlorobenzene, dichloroethane, methylene chloride or cyclohexanone to prepare a coating liquid for the charge transport layer 15. The thus prepared coating liquid for the charge transport layer 15 may be coated on the electroconductive support 11 or the charge generation layer 13, and dried.

For the polymeric charge transporting material for use in the charge transport layer 15, many conventional materials including the previously mentioned polymeric charge transporting materials for use in the charge generation layer 13 can be employed. The molecular weight of the polymerlc charge transporting material for use in the charge transport layer 15 is substantially determined by the solubility in the solvent to be employed, or the solution viscosity at the predetermined molecular weight.

To improve the photosensitivity of the photoconductor, it is preferable that the ionization potential ($I_P''$) of the polymeric charge transporting material for use in the charge transport layer 15 and the ionization potential ($I_P$) of the polymeric charge transporting material for use in the charge generation layer 13 satisfy the relationship of $(I_P'')<(I_P)+0.2$ eV.

The charge transport layer 15 may further comprise a binder resin, a plasticizer, and a leveling agent.

Examples of the binder resin for use in the charge transport layer 15 are thermoplastic resins and thermosetting resins such as polystyrene, styrene-acrylonitrile copolymer, stytens-butadiene copolymer, styrene—maleic anhydride copolymer, polyester, polyvinyl chloride, vinyl chloride-vinyl acetate copolymer, polyvinyl acetate, polyvinylidene chloride, polyerylate resin, phenoxy resin, polycarbonate, cellulose acetate resin, ethyl cellulose resin, polyvinyl butyral, polyvinyl formal, polyvinyl toluene, acrylic resin, silicone resin, epoxy resin, melamine resin, urethane resin, phenolic resin and alkyd resin.

It is preferable that the amount of the binder resin be in the range of 0 to 100 parts by weight to 100 parts by weight of the polymeric charge transporting material in the charge transport layer 15.

Any plasticizers used for general resins, such as dibutyl phthalate and dioctyl phthalate, may be contained in the charge transport layer 15. Such a plaeticizer may be contained in the charge transport layer in an amount of about 0 to 30 wt. % of the total weight of the polymeric charge transporting material.

Silicone oils such as dimethyl silicone oil and methylphenyl silicone oil, and polymers and elisomers having a perfluoroalkyl group on the side chain thereof can be used as the leveling agents in the charge transport layer 15. Such a leveling agent may be contained in the charge transport layer in an amount of about 0 to 1 wt. % of the total weight of the polymeric charge transporting material.

It is preferable that the thickness of the charge transport layer 15 be in the range of about 5 to 100 μm.

In the electrophotographic photoconductor of the present invention, an undercoat layer may be provided between the electroconductive support 11 and the photoconductive layer. The undercoat layer for use in the present invention comprises a resin as the main component. A resin with high resistance to generally used organic solvents is preferably employed because the photoconductive layer is provided on the undercoat layer using a solvent. Examples of such a resin for use in the undercoat layer include water-soluble resins such as polyvinyl alcohol, casein and sodium polyacrylate; alcohol-soluble resins such as copolymer nylon and methoxymethylated nylon; and cured resins with three dimensional network structure such as polyurethane, melamine resin, phenolic resin, alkyd-melamine resin and epoxy resin.

In addition, finely-divided pigment particles of metallic oxides such as titanium oxide, silica, alumina, zirconium oxide, tin oxide and indium oxide may be contained in the undercoat layer to prevent the appearance of moire and to reduce the residual potential. In this case, the undercoat layer can also be provided on the electroconductive support 11 using an appropriate solvent in accordance with the proper coating method as previously explained in the formation of the photoconductive layer.

The undercoat layer for use in the present invention may further comprise a coupling agent such as silane coupling agent, titanium coupling agent or chromium coupling agent.

Furthermore, to prepare the undercoat layer, $Al_2O_3$ may be deposited on the electroconductive support 11 by the anodizing process, or an organic material such as poly-para-xylylene (parylene), or inorganic materials such as SiO, $SnO_2$, $TiO_2$, ITO and $CeO_2$ may be vacuum-deposited on the electroconductive support 11.

It is preferable that the thickness of the undercoat layer be in the range of 0 to 5 μm.

In the present invention, a protective layer may be provided on the photoconductive layer to protect the photoconductive layer.

The protective layer for use in the present invention comprises a resin. Examples of such a resin include ABS resin, ACS resin, olefin-vinyl monomer copolymer, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethylphene, polypropylene, polyphenylene oxide, polysulfone, polystyrene, AS resin, butadiene-styrshe copolymer, polyurethane, polyvinyl chloride, polyvlnylidene chloride and epoxy resin.

The protective layer may further comprise a fluorine-containing resin such as polytetrafluoroethylene, and a silicone resin to improve the abrasion resistance. In addition, inorganic materials such as titanium oxide, tin oxide and potassium titanate may be dispersed in the above-mentioned resins.

The protective layer may be provided on the photoconductive layer by the conventional coating method. The thickness of the protective layer is preferably in the range of about 0.5 to 10 μm. Furthermore, a vacuum-deposited thin film of i-C or a-SiC may be used as the protective layer in the present invention.

Further, an intermediate layer may be interposed between the photoconductive layer and the protective layer. The intermediate layer comprises as the main component a binder resin such as polyamide, alcohol-soluble nylon resin, water-soluble polyvinyl butyral resin, polyvinyl butyral and polyvinyl alcohol.

The intermediate layer may also be provided by the conventional coating method. The proper thickness of the intermediate layer is in the range of about 0.05 to 2 μm.

Furthermore, an antioxidant may be contained in the electrophotographic photoconductor of the present invention to improve the environmental resistance of the photoconductor, in particular, to prevent the decrease of photosensitivity and the increase of residual potential due to oxidation. The antioxidant may be contained in any layer as long as the layer comprises an organic material. Particularly, when the antioxidant is contained in the layer which comprises the charge transporting material, good results can be obtained. Any conventional antioxidants may be used in the present invention, and the commercially available antioxidants for use in rubbers, plastics, and fats and oils may be employed.

In addition, an ultraviolet absorber may be contained in the photoconductive layer and/or the protective layer to protect the photoconductive layer when necessary.

Other features of this invention will become apparent in the course of the following description of exemplary embodiments, which are given for illustration of the invention and are not intended to be limiting thereof.

EXAMPLE 1

A coating liquid for a charge generation layer with a formulation (A) was prepared:

[Formulation (A)]

| | Parts by Weight |
|---|---|
| Charge generating material of the following formula: 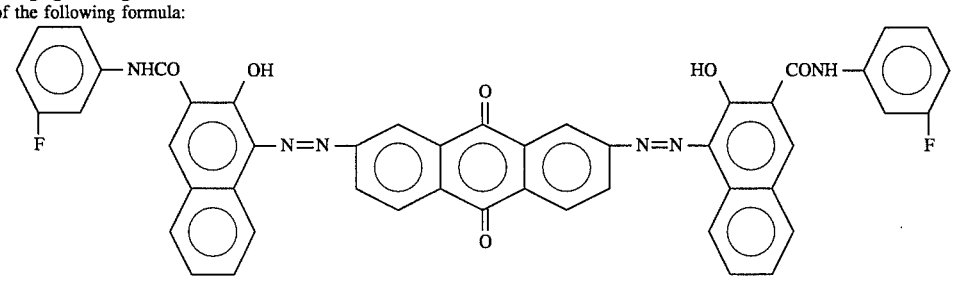 | 4 |
| Polymeric charge transporting material of the following formula: (Mw: about 12,000) 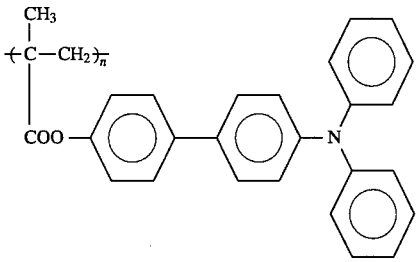 | 3 |
| Cyclohexanone | 200 |
| 2-butanone | 95 |

The thus prepared charge generation layer coating liquid was coated on an aluminum-deposited surface of a polyethylene terephthalate film serving as an electroconductive support, and dried, so that a charge generation layer with a thickness of 0.2 μm was formed on the electroconductive support.

A coating liquid for a charge transport layer with a formulation (B) was prepared:

[Formulation (B)]

| | Parts by Weight |
|---|---|
| Polymeric charge transporting material of the following formula: (Mw: about 20,000) | 10 |
| 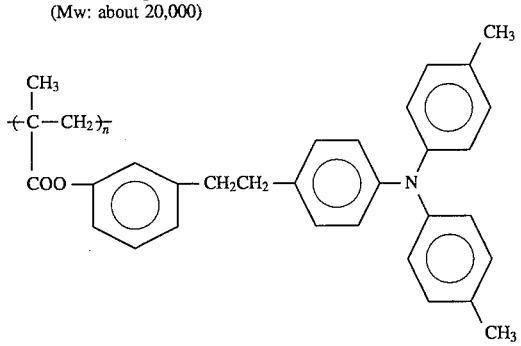 | |
| Methylene chloride | 80 |

The thus prepared charge transport layer coating liquid was coated on the above prepared charge generation layer, and dried, so that a charge transport layer with a thickness of 24 μm was formed on the charge generation layer.

Thus, an electrophotographic photoconductor No. 1 according to the present invention was obtained.

EXAMPLE 2

The procedure for preparation of the electrophotographic photoconductor No. 1 in Example 1 was repeated except that the polymeric charge transporting material for use in the charge generation layer coating liquid in Example 1 was replaced by a polymeric charge transporting material (Mw: about 35,000) of the following formula:

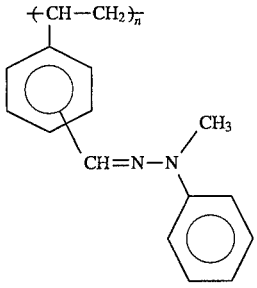

Thus, an electrophotographic photoconductor No. 2 according to the present invention was obtained.

EXAMPLE 3

The procedure for preparation of the electrophotographic photoconductor No. 1 in Example 1 was repeated except that the polymeric charge transporting material for use in the charge generation layer coating liquid in Example 1 was replaced by a polymeric charge transporting material (Mw: about 40,000) of the following formula:

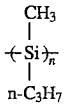

Thus, an electrographic photoconductor No. 3 according to the present invention was obtained.

COMPARATIVE EXAMPLE 1

The procedure for preparation of the electrophotographic photoconductor No. 1 in Example 1 was repeated except that the polymeric charge transporting material for use in the charge generation layer coating liquid in Example 1 was replaced by a polyvinyl butyral (Trademark "Denka Butyral #4000-1", made by Denki Kagaku Kogyo K.K.).

Thus, a comparative electrophotographic photoconductor No. 1 was obtained.

COMPARATIVE EXAMPLE 2

The procedure for preparation of the comparative electrophotographic photoconductor No. 1 in Comparative Example 1 was repeated except that 3 parts by weight of low-molecular weight charge transporting material of the following formula were added to the charge generation layer coating liquid for use in Comparative Example 1:

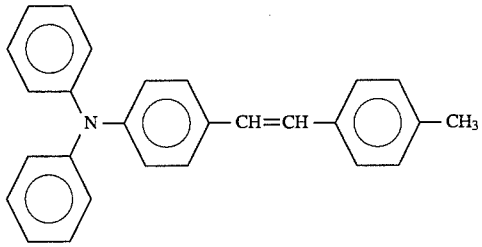

Thus, a comparative electrophotographic photoconductor No. 2 was obtained.

EXAMPLE 4

A coating liquid for a charge generation layer with a formulation (C) was prepared:

[Formulation (C)]

| | Parts by Weight |
|---|---|
| Charge generating material of the following formula: 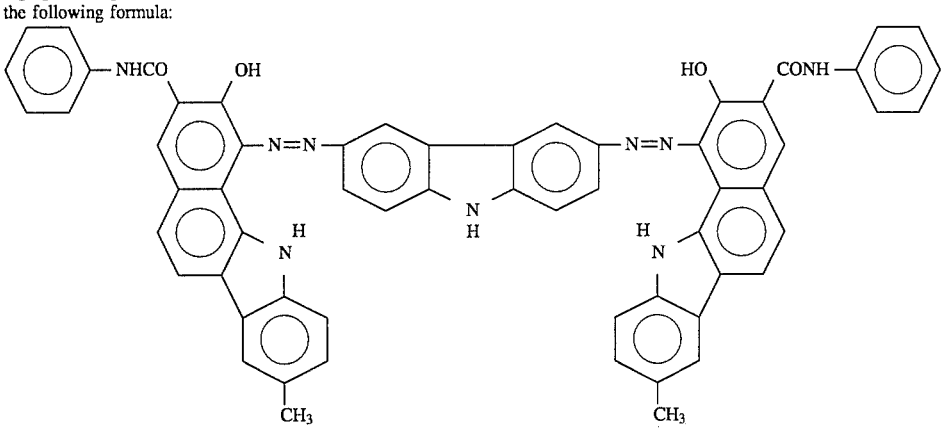 | 3 |
| Polymeric charge transporting material of the following formula: (Mw: about 30,000) 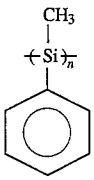 | 4 |
| Tetrahydrofuran | 180 |
| 2-butanone | 100 |

The thus prepared charge generation layer coating liquid was coated on an aluminum-deposited surface of a polyethylene terephthalate film serving as an electroconductive support, and dried, so that a charge generation layer with a thickness of 0.3 μm was formed on the electroconductive support.

A coating liquid for a charge transport layer with a formulation (D) was prepared:

[Formulation (D)]

| | Parts by Weight |
|---|---|
| Polymeric charge transporting material of the following formula: (Mw: about 30,000) 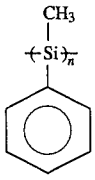 | 10 |
| Tetrahydrofuran | 80 |

The thus prepared charge transport layer coating liquid was coated on the above prepared charge generation layer, and dried, so that a charge transpork layer with a thickness of 19 μm was formed on the charge generation layer.

Thus, an electrophotographic photoconductor No. 4 according to the present invention was obtained.

EXAMPLE 5

The procedure for preparation of the electrophotographic photoconductor No. 4 in Example 4 was repeated except that the polymeric charge transporting material for use in the charge generation layer coating liquid in Example 4 was replaced by a polymeric charge transporting material (Mw: about 12,000) of the following formula:

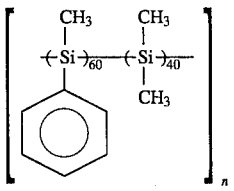

Thus, an electrophotographic photoconductor No. 5 according to the present invention was obtained.

EXAMPLE 6

The procedure for preparation of the electrophotographic photoconductor No. 4 in Example 4 was repeated except that the polymeric charge transporting material for use in the charge generation layer coating liquid in Example 4 was replaced by a polymeric charge transporting material (Mw: about 10,000) of the following formula:

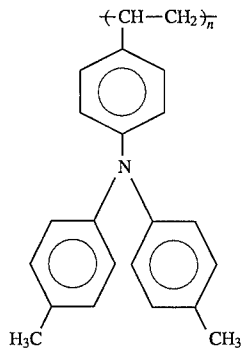

Thus, an electrophotographic photoconductor No. 6 according to the present invention was obtained.

EXAMPLE 7

The procedure for preparation of the electrophotographic photoconductor No. 4 in Example 4 was repeated except that the polymeric charge transporting material for use in the charge generation layer coating liquid in Example 4 was replaced by a formaldehyde condensation polymer of nitropylene.

Thus, an electrophotographic photoconductor No. 7 according to the present invention was obtained.

COMPARATIVE EXAMPLE 3

The procedure for preparation of the electrophotographic photoconductor No. 4 in Example 4 was repeated except that the polymeric charge transporting material for use in the charge generation layer coating liquid in Example 4 was replaced by a phenoxy resin (Trademark "VYHH" made by Union Carbide Japan K.K.)

Thus, a comparative electrophotographic photoconductor No. 3 was obtained.

EXAMPLE 8

A coating liquid for an undercoat layer with a formulation (E) was prepared:

| [Formulation (E)] | Parts by Weight |
|---|---|
| Finely-divided particles of titanium dioxide (Trademark "Tipaque R-670", made by Ishihara Sangyo Kainha, Ltd. | 15 |
| Polyvinyl butyral (Trademark "S-Lec BL-1", made by Sekisui Chemical Co., Ltd. | 3 |
| Epoxy resin (Trademark "Epicote 1001", made by Yuka Shell Epoxy K.K.) | 3 |
| 2-butanone | 150 |

The thus prepared undercoat layer coating liquid was coated on an aluminum plate with a thickness of 0.2 mm serving as an electroconductive support, and dried, so that an undercoat layer with a thickness of 2 μmwas formed on the electroconductive support.

A coating liquid for a charge generation layer with a formulation (F) was prepared:

[Formulation (F)]

| | Parts by Weight |
|---|---|
| Charge generating material of the following formula: | 4 |
| Polymeric charge transporting material of the following formula: (Mw: about 25,000) | 2 |
| Cyclohexanone | 200 |
| Methylcyclohexanone | 90 |

The thus prepared charge generation layer coating liquid was coated on the above prepared undercoat layer, and dried, so that a charge generation layer with a thickness of 0.2 μm was formed on the undercoat layer.

A coating liquid for a charge transport layer with a formulation (G) was prepared:

[Formulation (G)]

| | Parts by Weight |
|---|---|
| Polymeric charge transporting material of the following formula: (Mw: about 50,000) | 10 |

[Formulation (G)]-continued

| | Parts by Weight |
|---|---|
| 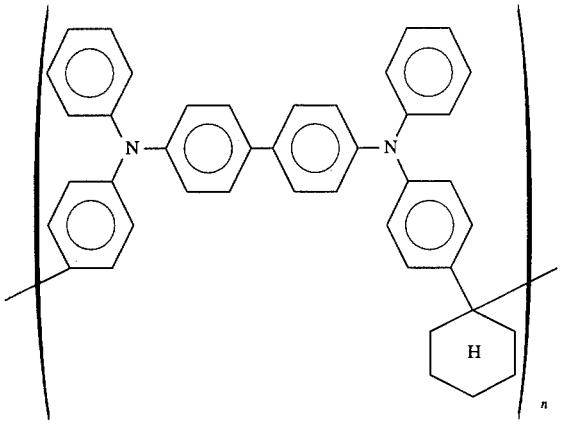 | |
| Methylene chloride | 80 |

The thus prepared charge transport layer coating liquid was coated on the above prepared charge generation layer, and dried, so that a charge transport layer with a thickness of 22 μm was formed on the charge generation layer.

Thus, an electrophotographic photoconductor No. 8 according to the present invention was obtained.

EXAMPLE 9

The procedure for preparation of the electrophotographic photoconductor No. 8 in Example 8 was repeated except that the polymeric charge transporting material for use in the charge generation layer coating liquid in Example 8 was replaced by a polymeric charge transporting material (Mw: about 40,000) of the following formula:

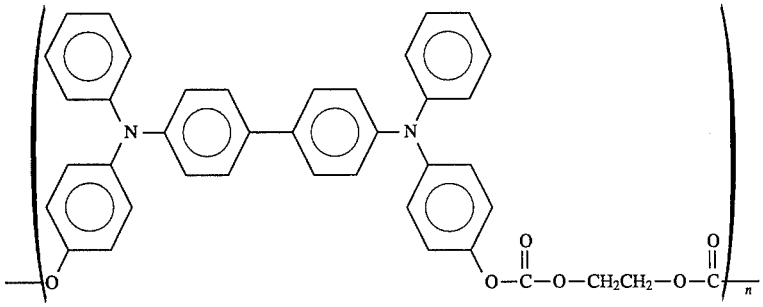

Thus, an electrophotographic photoconductor No. 9 according to the present invention was obtained.

EXAMPLE 10

The procedure for preparation of the electrophotographic photoconductor No. 8 in Example 8 was repeated except that the polymeric charge transporting material for use in the charge generation layer coating liquid in Example 8 was replaced by a polymeric charge transporting material (Mw: about 26,000) of the following formula:

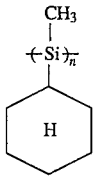

Thus, an electrophotographic photoconductor No. 10 according to the present invention was obtained.

COMPARATIVE EXAMPLE 4

The procedure for preparation of the electrophotographic photoconductor No. 8 in Example 8 was repeated except that the polymeric charge transporting material for use in the charge generation layer coating liquid in Example 8 was replaced by a polyvinyl formal (Trademark "Denka Formal #100", made by Denki Kagaku Kogyo K.K.).

Thus, a comparative electrophotographic photoconductor No. 4 was obtained.

COMPARATIVE EXAMPLE 5

The procedure for preparation of the comparative electrophotographic photoconductor No. 4 in Comparative Example 4 was repeated except that 2 parts by weight of a low-molecular weight charge transporting material of the following formula were added to the charge generation layer coating liquid for use in Comparative Example 4:

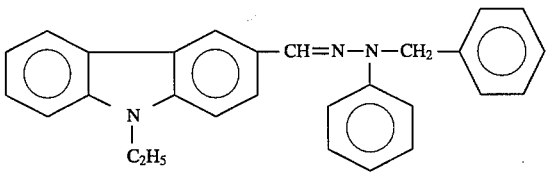

Thus, a comparative electrophotographic photoconductor No. 5 was obtained.

COMPARATIVE EXAMPLE 6

The procedure for preparation of the comparative electrophotographic photoconductor No. 4 in Comparative Example 4 was repeated except that 10 parts by weight of the same low-molecular weight charge transporting material of the following formula, as used in Comparative Example 5 were added to the charge transport layer coating liquid for use in Comparative Example 4:

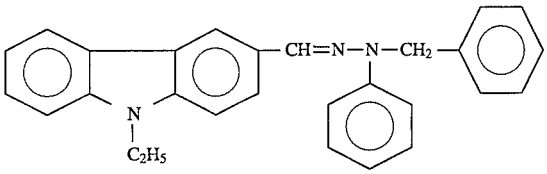

Thus, a comparative electrophotographic photoconductor No. 6 was obtained.

EXAMPLE 11

A coating liquid for a charge transport layer with a formulation (H) was prepared:

[Formulation (H)]

| | Parts by Weight |
|---|---|
| Polymeric charge transporting material of the following formula: (Mw: about 40,000) 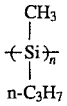 | 5 |
| Polymeric charge transporting material of the following formula: (Mw: about 60,000) 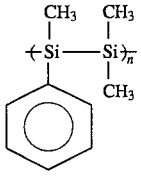 | 5 |
| Toluene | 80 |

The thus prepared charge transport layer coating liquid was coated on an aluminum plate with a thickness of 0.2 mm serving as an electroconductive support, and dried, so that a charge transport layer with a thickness of 20 μm was formed on the electroconductive support.

A coating liquid for a charge generation layer with a formulation (I) was prepared:

[Formulation (I)]

| | Parts by Weight |
|---|---|
| Charge generating material of the following formula: 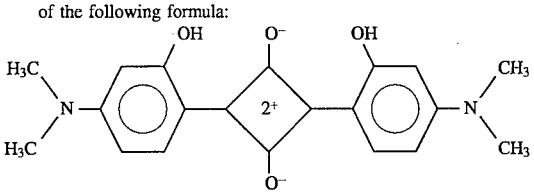 | 3 |
| Polymeric charge transporting material of the following formula: | 4 |

[Formulation (I)]-continued

| | Parts by Weight |
|---|---|
| (Mw: about 40,000) 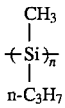 | |
| Cyclohexanone | 200 |

The thus prepared charge generation layer coating liquid was coated on the above prepared charge transport layer, and dried, so that a charge generation layer with a thickness of 0.4 μm was formed on the charge transport layer.

A coating liquid for a protective layer with a formulation (J) was prepared:

[Formulation (J)]

| | Parts by Weight |
|---|---|
| Antimony-oxide-containing tin oxide (Amount of antimony oxide: 10 wt. %) | 30 |
| Styrene - methacrylic acid - N-methylolmethacrylamide resin | 10 |
| Toluene | 80 |
| n-butanol | 70 |

The thus prepared protective layer coating liquid was coated on the above prepared charge generation layer, and dried, so that a protective layer with a thickness of 3 μm was formed on the charge generation layer.

Thus, an electrophotographic photoconductor No. 11 according to the present invention was obtained.

EXAMPLE 12

The procedure for preparation of the electrophotographic photoconductor No. 11 in Example 11 was repeated except that the polymeric charge transporting material for use in the charge generation layer coating liquid in Example 11 was replaced by a polymeric charge transporting material (Mw: about 12,000) of the following formula:

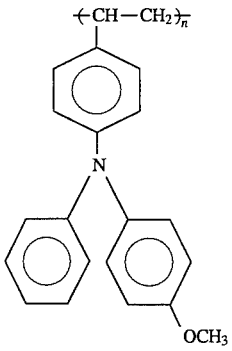

Thus, an electrophotographic photoconductor No. 12 according to the present invention was obtained.

EXAMPLE 13

The procedure for preparation of the electrophotographic photoconductor No. 11 in Example 11 was repeated except that the polymeric charge transporting material for use in the charge generation layer coating liquid in Example 11 was replaced by a polymeric charge transporting material (Mw: about 8,000) of the following formula:

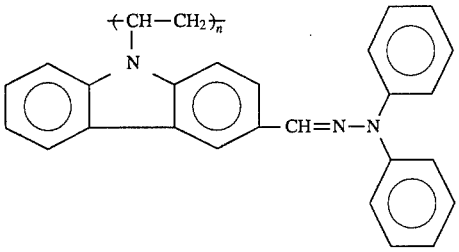

Thus, an electrophotographic photoconductor No. 13 according to the present invention was obtained.

COMPARATIVE EXAMPLE 7

The procedure for preparation of the electrophotographic photoconductor No. 11 in Example 11 was repeated except that the polymeric charge transporting material for use in the charge generation layer coating liquid in Example 11 was replaced by a polysulfone (Trademark "P-1700", made by Nissan Chemical Industries, Ltd.).

Thus, a comparative electrophotographic photoconductor No. 7 was obtained.

COMPARATIVE EXAMPLE 8

The procedure for preparation of the comparative electrophotographic photoconductor No. 7 in Comparative Example 7 was repeated except that 3 parts by weight of a low-molecular weight charge transporting material of the following formula were added to the charge generation layer coating liquid for use in Comparative Example 7:

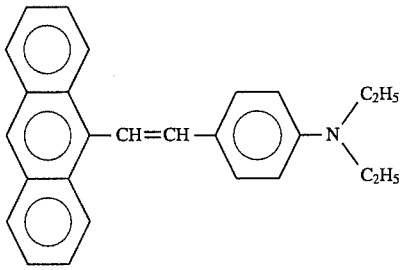

Thus, a comparative electrophotographic conductor No. 8 was obtained.

EXAMPLE 14

A coating liquid for an undercoat layer with a formulation (K) was prepared:

| [Formulation (K)] | Parts by Weight |
|---|---|
| 10% aqueous solution of water-soluble polyvinyl acetal (Trademark "W-101", made by Sekisui Chemical Co., Ltd.) | 15 |
| Water | 20 |
| Methanol | 50 |

The thus prepared undercoat layer coating liquid was coated on an aluminum plate with a thickness of 0.2 mm serving as an electroconductive support, and dried, so that an undercoat layer with a thickness of 0.3 μm was formed on the electroconductive support.

A coating liquid for a charge generation layer with a formulation (L) was prepared:

[Formulation (L)]

| | Parts by Weight |
|---|---|
| Charge generating material of the following formula: 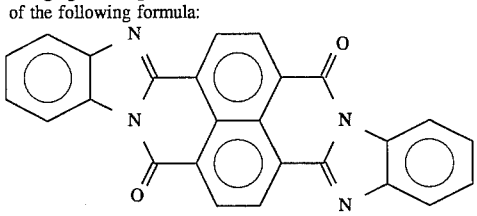 | 3 |
| Polymeric charge transporting material of the following formula: (Mw: about 12,000) 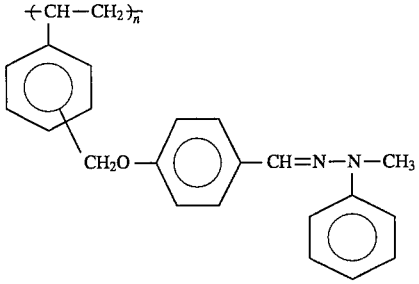 | 4 |
| Cyclohexanone | 200 |
| 4-methyl-2-pentanone | 90 |

The thus prepared charge generation layer coating liquid was coated on the above prepared undercoat layer, and dried, so that a charge generation layer with a thickness of 0.2 μm was formed on the undercoat layer.

A coating liquid for a charge transport layer with a formulation (M) was prepared:

[Formulation (M)]

| | Parts by Weight |
|---|---|
| Polycarbonate (Trademark "Panlite K-1300", made by Teijin Limited.) | 6 |
| Polymeric charge transporting material of the following formula: (Mw: about 7,000) 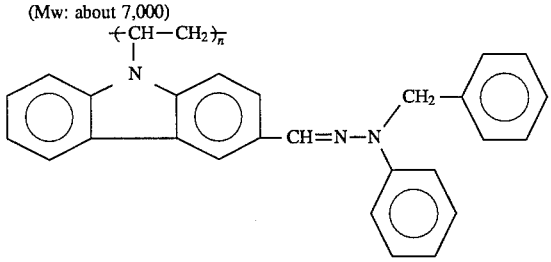 | 10 |
| Tetrahydrofuran | 80 |

The thus prepared charge transport layer coating liquid was coated on the above prepared charge generation layer, and dried, so that a charge transport layer with a thickness of 25 μm was formed on the charge generation layer.

Thus, an electrophotographic photoconductor No. 14 according to the present invention was obtained.

EXAMPLE 15

The procedure for preparation of the electrophotographic photoconductor No. 14 in Example 14 was repeated except that the polymeric charge transporting material for use in the charge generation layer coating liquid in Example 14 was replaced by a polymeric charge transporting material (Mw: about 14,000) of the following formula:

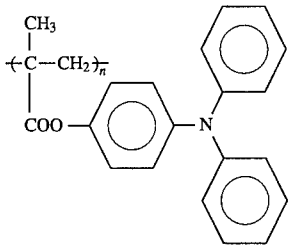

Thus, an electrophotographic photoconductor No. 15 according to the present invention was obtained.

EXAMPLE 16

The procedure for preparation of the electrophotographic photoconductor No. 14 in Example 14 was repeated except that the polymeric charge transporting material for use in the charge generation layer coating liquid in Example 14 was replaced by a polymeric charge transporting material (Mw: about 60,000) of the following formula:

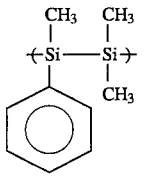

Thus, an electrophotographic photoconductor No. 16 according to the present invention was obtained.

EXAMPLE 17

The procedure for preparation of the electrophotographic photoconductor No. 14 in Example 14 was repeated except that the polymeric charge transporting material or use in the charge generation layer coating liquid in Example 14 was replaced by a polymeric charge transporting material (Mw: about 19,000) of the following formula:

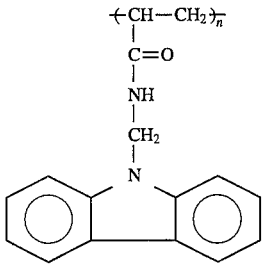

Thus, an electrophotographic photoconductor No. 17 according to the present invention was obtained.

COMPARATIVE EXAMPLE 9

The procedure for preparation of the electrophotographic photoconductor No. 14 in Example 14 was repeated except that the polymeric charge transporting material for use in the charge generation layer coating liquid in Example 14 was replaced by a phenoxy resin (Trademark "VYHH", made by Union Carbide Japan K.K.).

Thus, a comparative electrophotographic photoconductor No. 9 was obtained.

Each of the thus prepared electrophotographic photoconductors No. 1 through No. 17 according to the present invention and comparative electrophotographic photoconductors No. 1 through No. 9 was charged negatively or positively in the dark under application of −5.2 kV or +5.6 kv of corona charge for 10 seconds, using a commercially available electrostatic copying sheet testing apparatus ("Paper Analyzer Model SP-428", made by Kawaguchi Electro Works Co., Ltd.). The surface potential $v_{10}$ (v) of each photoconductor was measured 10 seconds after the initiation of charging. Then, each photoconductor was allowed to stand in the dark for 10 seconds without applying any charge there=o, and the surface potential $V_{20}$ (V) was measured after the dark decay. Each photoconductor was then illuminated by a tungsten lamp in such a manner that the lllumtnance on the illuminated surface of the photoconductor was 5 lux, and the exposure $E_{1/2}$ (lux.sec) required to reduce the surface potential $V_{20}$ (V) to ½ the surface potential $V_{20}$ (V) was measured. In addition, the surface potential $V_{40}$ (V) of each photoconductor wes measured after the photoconductor was exposed to the tungsten lamp for 20 seconds.

The results are shown in TABLE 1.

TABLE 1

| | $V_{10}$ (V) | $V_{20}$ (V) | $E_{1/2}$ (lux · sec) | $V_{40}$ (V) |
|---|---|---|---|---|
| Ex. 1 | −1307 | −1002 | 1.08 | 0 |
| Ex. 2 | −1283 | −928 | 1.11 | −2 |
| Ex. 3 | −1246 | −951 | 1.06 | −1 |
| Comp. Ex. 1 | −1415 | −1174 | * | 625 |
| Comp. Ex. 2 | −1344 | −1032 | 1.86 | −37 |
| Ex. 4 | −1187 | −934 | 0.87 | −3 |
| Ex. 5 | −1096 | −915 | 0.85 | −2 |
| Ex. 6 | −1136 | −927 | 0.90 | 0 |
| Ex. 7 | −1216 | −970 | 1.01 | −15 |
| Comp. Ex. 3 | −1289 | −1064 | * | −524 |
| Ex. 8 | −1031 | −874 | 1.05 | −2 |
| Ex. 9 | −1016 | −856 | 1.03 | 0 |
| Ex. 10 | −1045 | −839 | 1.02 | 15 |
| Comp. Ex. 4 | −1172 | −947 | * | −483 |
| Comp. Ex. 5 | −1126 | −901 | 1.79 | −29 |
| Comp. Ex. 6 | −1065 | −844 | 1.00 | −2 |
| Ex. 11 | 1162 | 907 | 1.22 | 4 |
| Ex. 12 | 1104 | 924 | 1.09 | 2 |
| Ex. 13 | 1097 | 911 | 1.15 | 5 |
| Comp. Ex. 7 | 1171 | 982 | * | 517 |
| Comp. Ex. 8 | 1125 | 904 | 1.70 | 3 |
| Ex. 14 | −1362 | −1004 | 1.85 | −7 |
| Ex. 15 | −1297 | −1018 | 1.7 | −4 |
| Ex. 16 | −i326 | −996 | 1.71 | −6 |
| Ex. 17 | −1288 | −989 | 2.76 | −31 |

TABLE 1-continued

| | $V_{10}$ (V) | $V_{20}$ (V) | $E_{1/2}$ (lux · sec) | $V_{40}$ (V) |
|---|---|---|---|---|
| Comp. Ex. 9 | −1385 | −1050 | 5.76 | −162 |

*It was impossible to obtain the value of $E_{1/2}$ because the surface potential $V_{20}$ did not reduce to ½ the surface potential $V_{20}$ within 20 seconds of exposure.

As can be seen from the results shown in TABLE 1, the electrophotographic photoconductors of the present invention exhibit high photosensitivity and high-speed photoresponse performance.

Furthermore, the photoconductor No. 8 according to the present invention and the comparative photoconductor No. 6 were subjected to the abrasion test, using a commercially available abrasion tester "Rotary Abrasion Tester", made by Toyo Seiki Seisaku-sho, Ltd. As a result, the abrasion amount of the photoconductor No. 8 of the present invention was 0.02 g, and that of the comparative photoconductor No. 6 was 0.11 g after 1,000 rotations.

It is apparent that the photoconductor of the present invention is superior in the abrasion resistance.

As previously explained, the problem of low photosensitivity caused by the conventional functionseparating laminated photoconductor in which a polymeric charge transporting material is employed in the charge transport layer can be solved by adding a polymeric charge transporting material to the charge generation layer. According to the present invention, a photoconductor with high photosensitivity can be provided even though the polymeric charge transporting material is employed in the charge transport layer.

Further, the abrasion resistance of the photoconductor according to the present invention is excellent.

Japanese Patent Application No. 5-262409 filed on Oct. 20, 1993 is hereby incorporated by reference.

What is claimed is:

1. An electrophotographic photoconductor comprising an electroconductive support and a photoconductive layer formed thereon, which comprises at least a charge generation layer comprising a charge generating material selected from the group consisting of azo pigments, perinone pigments and squaraines, and a polymeric charge transporting material, and a charge transport layer comprising a polymeric charge transporting material, wherein said polymeric charge transporting material in said charge generation layer is selected from the group consisting of polysilylene, a polymer having a hydrazone structure on the main chain and/or side chain thereof, and a polymer having a tertiary amine structure on the main chain and/or side chain thereof, and said polymeric charge transporting material in said charge transport layer is selected from the group consisting of polysilylene, a polymer having a hydrazone structure on the main chain and/or side chain thereof, and a polymer having a tertiary amine structure on the main chain and/or side chain thereof.

2. The electrophotographic photoconductor as claimed in claim 1, wherein said polymeric charge transporting material for use in said charge generation layer is polysilylene.

3. The electrophotographic photoconductor as claimed in claim 1, wherein said polymeric charge transporting material for use in said charge generation layer is a polymer having a hydrazone structure on the main chain and/or side chain thereof.

4. The electrophotographic photoconductor as claimed in claim 1, wherein said polymeric charge transporting material for use in said charge generation layer is a polymer having a tertiary amine structure on the main chain and/or side chain thereof.

5. The electrophotographic photoconductor as claimed in claim 1, wherein said charge generating material for use in said charge generation layer is said azo pigment.

6. The electrophotographic photoconductor as claimed in claim 5, wherein said polymeric charge transporting material in said charge generation layer is polysilylene.

7. The electrophotographic photoconductor as claimed in claim 5, wherein said polymeric charge transporting material in said charge generation layer is a polymer having a hydrazone structure on the main chain and/or side chain thereof.

8. The electrophotographic photoconductor as claimed in claim 5, wherein said polymeric charge transporting material in said charge generation layer is a polymer having a tertiary amine structure on the main chain and/or side chain thereof.

9. The electrophotographic photoconductor as claimed in claim 1, wherein said polymeric charge transporting material in said charge generation layer is a polymer having a weight-average molecular weight of 1,000 to 2,000,000.

10. The electrophotographic photoconductor as claimed in claim 9, wherein the weight-average molecular weight of said polymeric charge transporting material in said charge generation layer is 10,000 to 1,000,000.

11. The electrophotographic photoconductor as claimed in claim 10, wherein the polymeric charge transporting material in said charge transport layer is the same as the polymeric charge transporting material in said charge generation layer.

12. The electrophotographic photoconductor as claimed in claim 9, wherein the polymeric charge transporting material in said charge transport layer is the same as the polymeric charge transporting material in said charge generation layer.

* * * * *